United States Patent [19]

Yokoi et al.

[11] Patent Number: 4,660,749

[45] Date of Patent: Apr. 28, 1987

[54] SLIDING NOZZLE APPARATUS

[75] Inventors: Nobuyuki Yokoi; Toshimitsu Taira; Koji Tsuyuguchi, all of Kitakyushu, Japan

[73] Assignee: Kurosaki Refractories Co., Ltd., Fukuoka, Japan

[21] Appl. No.: 774,198

[22] Filed: Sep. 9, 1985

[30] Foreign Application Priority Data

Sep. 11, 1984 [JP] Japan ..... 59-138491[U]

[51] Int. Cl.[4] ..... B22D 41/08; C21C 5/48

[52] U.S. Cl. ..... 222/600; 266/271

[58] Field of Search ..... 222/600, 598, 591, 594, 222/597; 266/236, 271

[56] References Cited

U.S. PATENT DOCUMENTS

| | | | |
|---|---|---|---|
| 4,116,372 | 2/1978 | Horiguchi et al. | 222/600 |
| 4,189,073 | 2/1980 | Lothmann | 222/600 |
| 4,253,647 | 3/1981 | Andres | 222/600 X |

*Primary Examiner*—Joseph J. Rolla

*Assistant Examiner*—Nils Pedersen

*Attorney, Agent, or Firm*—Jordan and Hamburg

[57] ABSTRACT

A sliding nozzle apparatus for a molten metal holding vessel including a fixed nozzle member and a fixed plate therefor which are supported by an upper or fixed bracket secured to the vessel, and a movable nozzle member and a slidable plate therefor which are supported by a lower or movable bracket having one edge hinged to the upper bracket, while its opposite edge remote from its hinged connection to the upper bracket is removably connectable to the upper bracket to bring the slidable plate into contact with the fixed plate. A first set of coil springs are located adjacent to the edge of the lower bracket at which it is hinged to the upper bracket, and a second set of coil springs are located adjacent to the opposite edge of the lower bracket. The first set of coil springs are deflected to a greater degree than the second set of coil springs, or are, in other words, preloaded differently from the second set of springs.

2 Claims, 5 Drawing Figures

SLIDING NOZZLE APPARATUS

BACKGROUND OF THE INVENTION

1. Field of the Invention

This invention relates to a sliding nozzle apparatus which is used for controlling the flow of the molten metal poured from a molten metal holding vessel.

2. Description of the Prior Art

There are known various types of sliding nozzle apparatuses which are used for the purpose hereinabove stated. One of them is shown by way of example in FIGS. 4 and 5.

The apparatus is associated with a vessel 1 for holding molten steel. The apparatus includes an upper nozzle member 3 provided in the bottom wall of the vessel 1 which is formed by a steel plate shell 2 and a refractory wall lining it. An upper bracket 5 is secured to the shell 2 and supports a fixed plate 4 having an axial hole aligned with the nozzle member 3.

The apparatus also includes a sliding plate 6 which is horizontally slidable relative to the fixed plate 4, and a lower nozzle member 7. The sliding plate 6 and the lower nozzle member 7 are supported in a slidable supporting member 8 which is supported in a lower bracket 11 horizontally slidably by a drive cylinder. The lower bracket 11 has one edge connected rotatably to the upper bracket 5 by pins 14. Another edge of the lower bracket 11 which is remote from its rotatably connected edge is removably connectable to the upper bracket 5 by a bolt 15 and a nut 16 as shown in FIG. 5, so that the lower plate 6 and the lower nozzle member 7 may be aligned with the upper plate 4 and the upper nozzle member 3. The lower bracket 11 is provided with a coil spring 10 adjacent to each of the edges at which it is, or can be, connected to the upper bracket 5. Each spring 10 is preloaded by a bolt 12 and a nut 13. A holder 9 for holding the heads of the bolts 12 is disposed between the slidable supporting member 8 and the lower bracket 11.

When the apparatus is moved from its position shown in FIG. 4 to its position shown in FIG. 5, the lower bracket 11 is rotated toward the vessel 1 and connected to the upper bracket 5 by the bolt 15 and the nut 16, whereby the slidable plate 6 is pressed against the fixed plate 4.

Until the nut 16 is appropriately tightened, however, the two plates 4 and 6 contact each other only at the edges thereof which are closed to the hinged joint between the upper and lower brackets 5 and 11, while a clearance exists between the plates 4 and 6 at the opposite edges thereof as shown at $\delta$ in FIG. 5. The force created when the nut 16 is tightened is, therefore, concentrated on the mutually contacting portions of the plates 4 and 6 and thereby causes their surfaces to crack or get otherwise damaged.

SUMMARY OF THE INVENTION

Under these circumstances, it is an object of this invention to provide an improved sliding nozzle apparatus including a fixed plate, a fixed nozzle member, a movable plate and a movable nozzle member which are adapted to contact each other over the whole surfaces thereof when they are brought into mutual alignment, and which are free from any damage due to the concentration of the force exerted to bring them into contact with each other.

This object is essentially attained by an apparatus including a first set of coil springs which are provided adjacent to that edge of a movable bracket which is rotatably secured to a fixed bracket, and which are deflected to a greater degree than a second set of coil springs provided adjacent to the edge of the movable bracket which is removably connectable to the fixed bracket.

BRIEF DESCRIPTION OF THE DRAWINGS

FIG. 1 to FIG. 4 show an embodiment of this invention, wherein the feature of this invention will be clear by the following description along to the drawings.

FIGS. 4 and 5 show cross sectional front views of a sliding nozzle apparatus as a prior art.

DESCRIPTION OF THE PREFERRED EMBODIMENT

Figure 1:
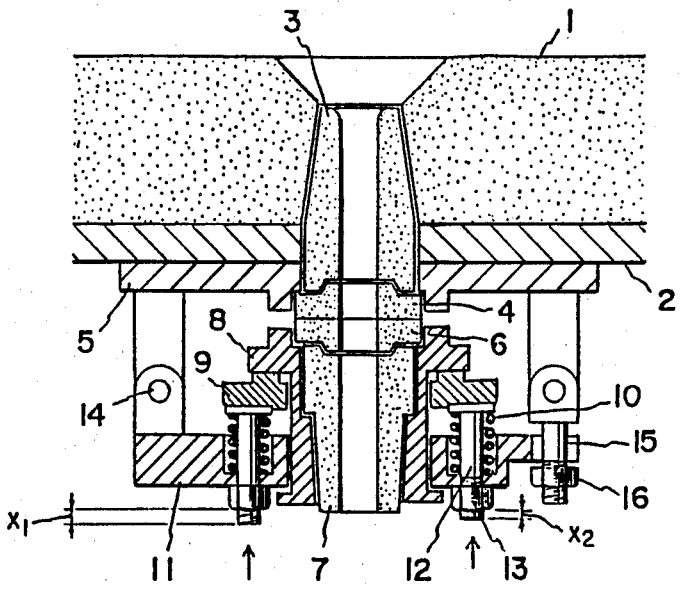
FIG. 1 is a front elevational view, partly in section, of a sliding nozzle member embodying this invention.
Figure 2:
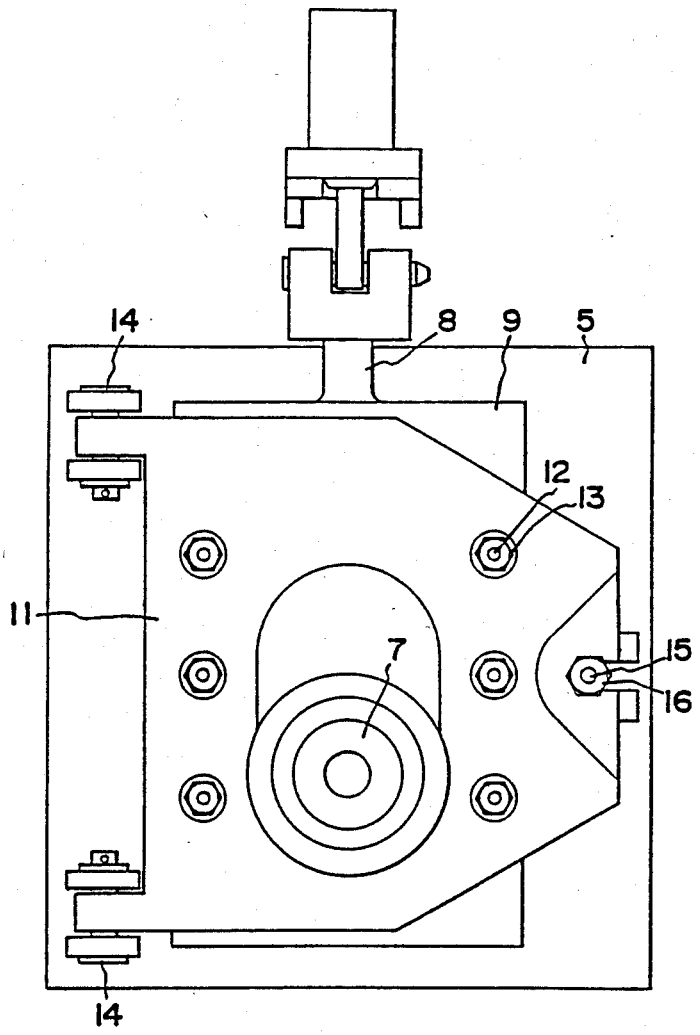
FIG. 2 is a bottom plan view of the apparatus shown in FIG. 1.
Figure 4:
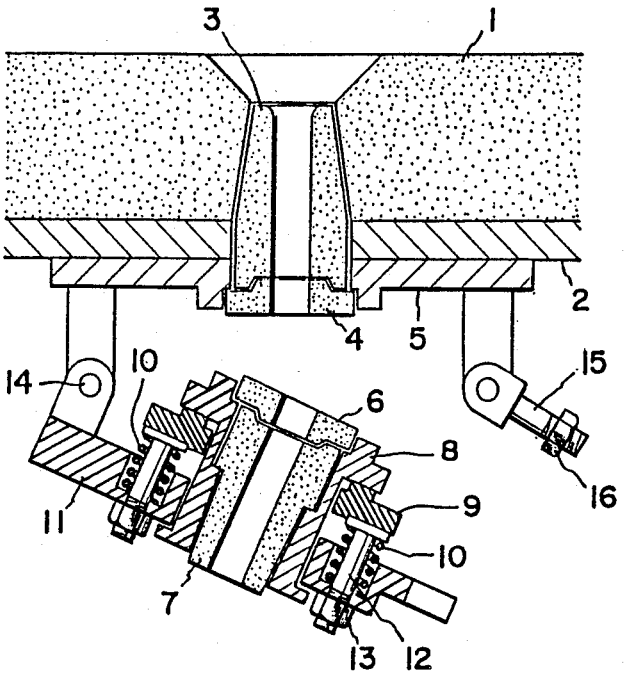
FIG. 4 PRIOR ART
Figure 5:
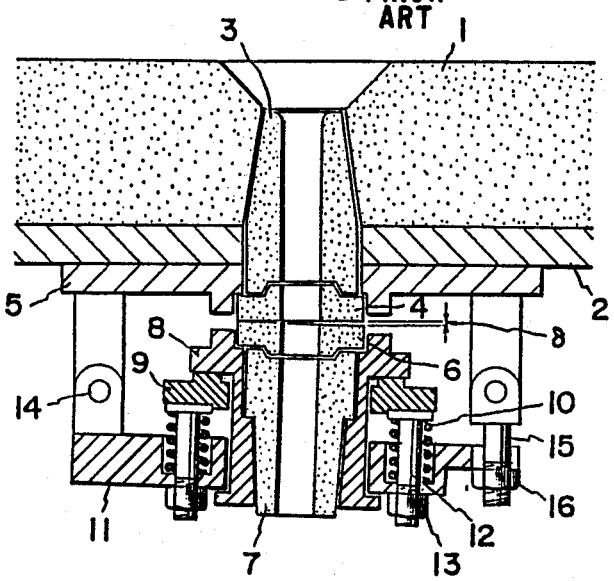
FIG. 5 PRIOR ART

A sliding nozzle apparatus embodying this invention is shown in FIGS. 1 and 2. As is obvious from the drawings, it is substantially identical in construction to the conventional apparatus shown in FIGS. 4 and 5. It comprises an upper nozzle member 3, a fixed plate 4 therefor, an upper bracket 5 secured to the shell 2 of a molten steel holding vessel 1, a sliding plate 6, a lower nozzle member 7, a slidable supporting member 8, a spring holder 9, a plurality of coil springs 10, a lower bracket 11, a plurality of bolts 12 and nuts 13 for holding the springs 10, a plurality of pins 14 by which the lower bracket 11 is rotatably secured to the upper bracket 5, and a bolt 15 and a nut 16 by which the lower bracket 11 is removably connectable to the upper bracket 5. No further description is made, insofar as the apparatus of this invention is substantially identical in construction to the conventional apparatus.

According to a salient feature of this invention, the first set of coil springs 10 which are located adjacent to that edge of the lower bracket 11 which is rotatably secured to the upper bracket 5 are deflected to a greater degree, as shown at $x_1$ in FIG. 1, than the second set of coil springs 10 located adjacent to the edge of the lower bracket 11 which is removably connected to the upper bracket 5 are, as shown at $x_2$. This difference in the degree of preloading between the first and second sets of coil springs 10 enables the fixed and sliding plates 4 and 6 to remain in contact with each other over the whole surfaces thereof when the nut 16 is tightened.

As is obvious from FIG. 2, the apparatus includes only a single bolt 15 and a single nut 16 for connecting the lower bracket 11 to the upper bracket 5 removably. It is, therefore, possible to finish easily and quickly the work of connecting the lower bracket 11 to the upper bracket 5 and bringing the sliding plate 6 into intimate contact with the fixed plate 4.

The degrees $x_1$ and $x_2$ of deflection of the coil springs 10 are adjustable even if the shapes of the plates 4 and 6 or the upper and lower brackets 5 and 11, or the position of the hinged joint between the brackets 5 and 11 is altered appropriately to keep the contact condition between both plates in face-contact.

According to this invention, the degrees $x_1$ and $x_2$ of deflection can advantageously be fixed, depending upon the shapes of the plates 4 and 6. In this connection, a suitable arrangement is shown by way of example in FIG. 3.

Figure 3:
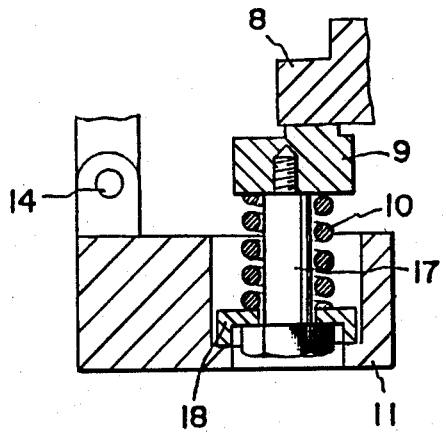
FIG. 3 is a fragmentary enlarged view of a modified apparatus according to this invention.

The apparatus shown in FIG. 3 includes a plurality of coil springs 10 each supported about a preloading bolt 17 and between a spring holder 9 and a preloading ring 18 encircling the bolt 17 and held against its head. The bolt 17 has an end connected threadedly into the holder 9.

Although the invention has been described with reference to a preferred embodiment thereof including two mutually alignable plates, it is also applicable to a sliding nozzle apparatus having three such plates, or a rotary sliding nozzle apparatus.

What is claimed is:

1. In a sliding nozzle apparatus for a molten metal holding vessel comprising an upper nozzle member, a fixed plate secured to said upper nozzle member, an upper bracket secured to the outer surface of said vessel and cooperating with said vessel to support said nozzle member and said fixed plate, a lower bracket having one edge connected pivotably to said upper bracket and an opposite edge which is detachably connectable to said upper bracket, a slidable supporting member supported horizontally slidably in said lower bracket, a lower nozzle member supported by said slidable supporting member, a sliding plate attached to said lower nozzle member, first coil springs provided in said lower bracket adjacent to said one edge thereof, second coil springs provided in said lower bracket and located adjacent to the opposite side of said lower bracket, a holder for said springs disposed between said slidable supporting member and said springs such that said first springs are disposed between said one edge of said lower bracket and a first edge of said holder and said second springs are disposed between said opposite edge of said lower bracket and an opposite second edge of said holder, said lower bracket being pivotable to an operable position in which said opposite edge is connected to said upper bracket and said springs urge said sliding plate into contact with said fixed plate, said lower bracket being pivotable to an inoperable position in which said opposite edge is disconnected from said upper bracket and said sliding plate is out of contact with said fixed plate, the spatial relationship between said lower bracket and said holder when said lower bracket is in said inoperable position being such that the distance of said one edge of said lower bracket from said first edge of said holder is less than the distance of said opposite edge of said lower bracket from said second edge of said holder, said spatial relationship between said lower bracket and said holder providing for even contact between said fixed plate and said sliding plate when said lower bracket is pivoted to said operable position to dispose said sliding plate into contact relationship with said fixed nozzle, whereby said even contact prevents damage to said sliding and fixed plates.

2. In a sliding nozzle apparatus for a molten metal holding vessel comprising an upper nozzle member, a fixed plate secured to said upper nozzle member, an upper bracket secured to the outer surface of said vessel and cooperating with said vessel to support said nozzle member and said fixed plate, a lower bracket having one edge connected pivotably to said upper bracket and an opposite edge which is detachably connectable to said upper bracket, a slidable supporting member supported horizontally slidably in said lower bracket, a lower nozzle member supported by said slidable supporting member, a sliding plate attached to said lower nozzle member, first coil springs provided in said lower bracket adjacent to said one edge thereof, second coil springs provided in said lower bracket and located adjacent to the opposite edge of said lower bracket, a holder for said springs disposed between said slidable supporting member and said springs such that said first springs are biasingly disposed between said one edge of said lower bracket and a first edge of said holder and said second springs are biasingly disposed between said opposite edge of said lower bracket and an opposite second edge of said holder, said springs urging said sliding plate to contact said fixed plate when said opposite edge of said lower bracket is connected to said upper bracket, said first springs having an adjusted axial length shorter than the adjusted axial length of said second coil springs such that the distance of said one edge of said lower bracket from said first edge of said holder is less than the distance of said opposite edge of said lower bracket from said second edge of said holder, and spring adjustment means for adjusting the axial length of said coil springs such that the aforesaid spatial relationship between said lower bracket and said holder is achieved by said spring adjustment means, said spatial relationship between said lower bracket and said holder providing for even contact between said fixed plate and said sliding plate when said lower bracket is rotated to an operable position to dispose said sliding plate into contact relationship with said fixed nozzle, whereby said even contact prevents damage to said sliding and fixed plates.

* * * * *